US005450880A

United States Patent [19]

Briner

[11] Patent Number: 5,450,880

[45] Date of Patent: Sep. 19, 1995

[54] INSERTION VEHICLE AND CARRIAGE FOR CHANGING A FABRIC TO BE WOVEN ON A LOOM

[75] Inventor: Emil Briner, Winterthur, Switzerland

[73] Assignee: Sulzer Ruti AG, Ruti, Switzerland

[21] Appl. No.: 180,403

[22] Filed: Jan. 11, 1994

[30] Foreign Application Priority Data

Apr. 16, 1993 [EP] European Pat. Off. ..... 93810281

[51] Int. Cl.[6] ..... D03J 1/00

[52] U.S. Cl. ..... 139/1 R; 28/208

[58] Field of Search ..... 28/208; 139/1 R

[56] References Cited

U.S. PATENT DOCUMENTS

| | | | |
|---|---|---|---|
| 4,910,837 | 3/1990 | Fujimoto et al. | 139/1 R |
| 4,934,413 | 6/1990 | Yao | 139/1 R |
| 5,307,844 | 5/1994 | Gruwez | 139/1 R |
| 5,322,088 | 6/1994 | Sampers | 139/1 R |

FOREIGN PATENT DOCUMENTS

| | | |
|---|---|---|
| 1022823 | 3/1953 | France . |
| 1535942 | 5/1970 | Germany . |
| 3523693 | 3/1986 | Germany . |
| 3708598 | 10/1987 | Germany . |
| 661065 | 6/1987 | Switzerland . |

*Primary Examiner*—Andrew M. Falik
*Attorney, Agent, or Firm*—Townsend and Townsend Khourie and Crew

[57] ABSTRACT

In the combination of a carriage for the preparation and storage of fabric to be changed on a loom, a loom for receiving the fabric to be changed, and an insertion vehicle for changing the fabric at the loom, improvements in the method of fabric change as well as the associated carriage and insertion vehicle are set forth. The method allows the carriage for the preparation and storage of fabric to be changed to have the working distance between the warp stop motion and the loom to be adjusted dependent upon shed size, density of fabric and warp material. The carriage for the preparation and storage of fabric includes a warp clamp and adjustment for spacing the warp stop motion with respect to the loom harness and heald frames. The insertion vehicle includes a centering mechanism for placing the loom harness and heald frames to the loom.

7 Claims, 9 Drawing Sheets

INSERTION VEHICLE AND CARRIAGE FOR CHANGING A FABRIC TO BE WOVEN ON A LOOM

The present invention relates to a process for changing a fabric to be manufactured on a loom and also a device for performing the process.

BACKGROUND OF THE INVENTION

French Patent Specification no. 1,022,823 discloses a loom which consists of a loom part and a Carriage. The loom part substantially includes the main drive, the shaft drive and the guides for the heald frames while the carriage substantially includes the warp beam and the Warp Stop motion and the heald frames. The carriage is equipped with a spooled warp beam outside the weaving room, the warp threads of which are drawn into the warp stop motion, the heald frames and the reed. The carriage equipped in this manner is coupled to the loom part, whereby the heald frames are further inserted into the shaft guides and coupled to the shaft drive. In this way a rapid fabric change may occur and an empty warp beam can be replaced by a full Warp beam.

However in this case the fact that in addition roughly half a loom has to be made available in order to perform a fabric or a warp beam change has proved to be a disadvantage. This is associated with considerable costs, because normally a majority of such carriages with corresponding fabrics or with a full warp beam have to be prepared and placed in readiness.

SUMMARY OF THE INVENTION

In the combination of a carriage for the preparation and storage of fabric to be changed on a loom, a loom for receiving the fabric to be changed, and an insertion vehicle for changing the fabric at the loom, improvements in the method of fabric change as well as the associated carriage and insertion vehicle are set forth. The method allows the carriage for the preparation and storage of fabric to be changed to have the working distance between the warp stop motion and the loom to be adjusted dependent upon shed size, density of fabric and warp material. The carriage for the preparation and storage of fabric includes a warp clamp and adjustment for spacing the warp stop motion with respect to the loom harness and heald frames. The insertion vehicle includes a centering mechanism for placing the loom harness and heald frames to the loom.

The object of the invention is to create a process for changing the loom harness, in which, whilst avoiding the disadvantage mentioned, the change is performed by a person with a greatly reduced expenditure of time and money.

The advantages which can be achieved with the invention are regarded as being that the process can be performed by an operator, the period for the change of fabric in the loom is substantially reduced, the fabric change is also possible with low yardages at a low cost in relation to material expenditure and the loom downtimes are considerably reduced, with a correspondingly positive affect on the productivity of a weaving operation.

BRIEF DESCRIPTION OF THE DRAWINGS

The invention is explained below by means of the attached drawings.

DESCRIPTION OF THE PREFERRED EMBODIMENT

Figure 1:
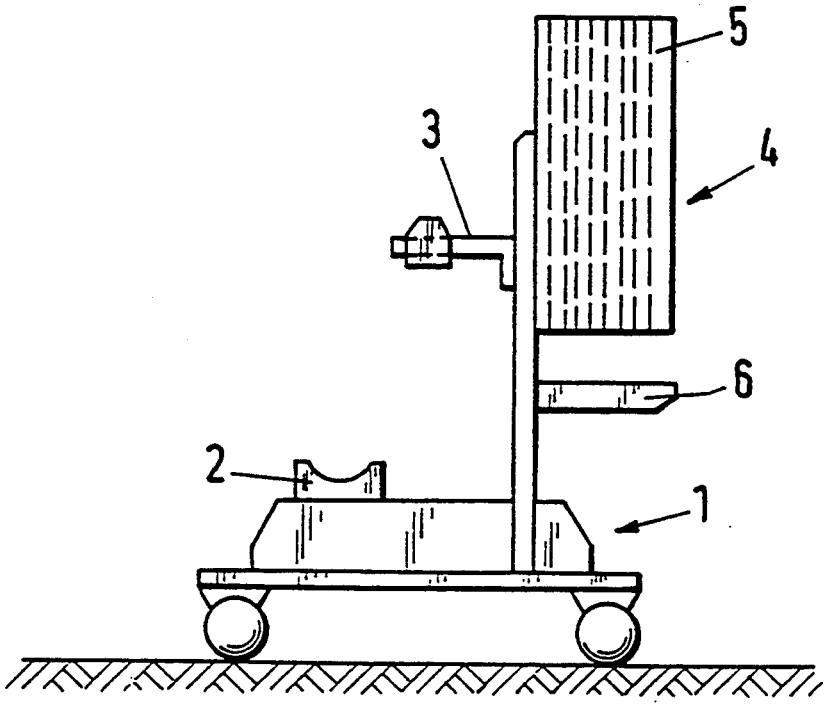
FIG. 1 shows a side view of a carriage for the preparation of the fabric change.

FIG. 1 shows a carriage 1, which is provided to transport and to store a fabric to be changed.

The carriage contains a support 2 for a warp beam, a support 3 for a warp stop motion and a retention device 4 consisting of guides 5 and a support 6 for a number of heald frames.

The following description is based on a fabric change which includes the warp beam, the warp stop motion and the loom harness.

For this purpose the carriage 1 described above is equipped with a warp beam 11 and is driven to a per se known drawing in device (not represented).

Figure 2:
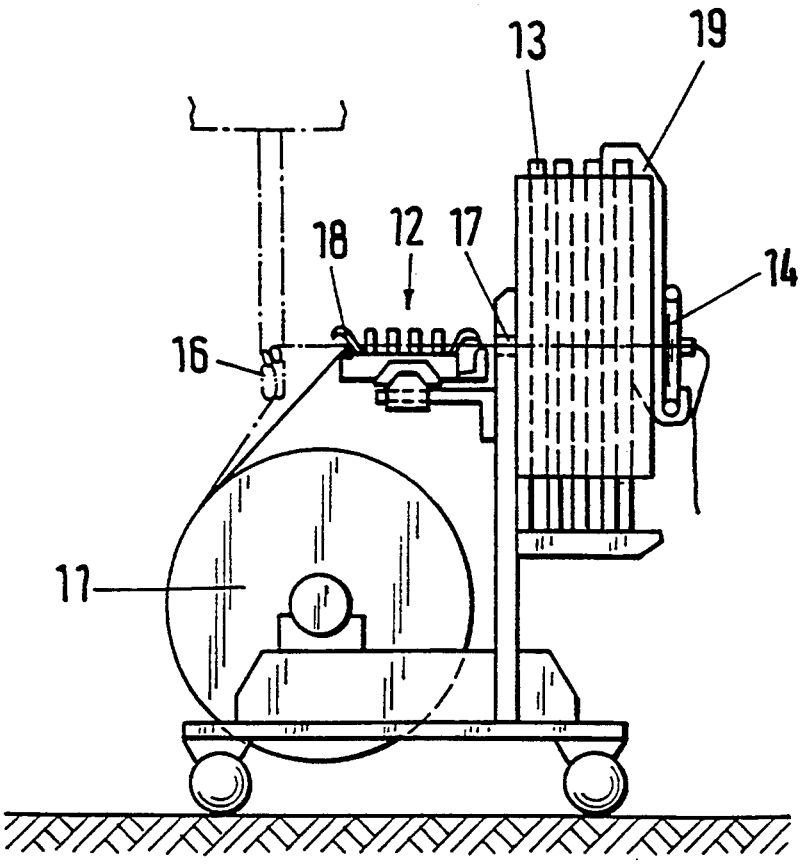
FIG. 2 shows a side view of FIG. 1 with the drawn-in fabric.

Reference is made to FIG. 2. The drawing-in of the warp threads into the drop wires, the heddles and the reed is performed in a known manner and with known devices. After drawing in, the uncoupling of the drawing-in carriage including carriage 1 is performed in a known manner, and then the drawn-in and completed warp stop motion, and also the heald frames and the reed are transferred to the carriage 1. The above-mentioned drawing-in and the transfer by the carriage 1 is performed according to the principle essential for the invention under discussion here: The fixing of the warp threads on the warp side before drawing-in is to be maintained until the fabric change on the loom. This fixing is performed with a clamping device 16, which is provided on the drawing-in device. After take-over by the carriage 1, the warp threads 15 are fixed in a clamping device 17 on the carriage 1, whereby the warp threads can be guided over a support tube 18, which can be inserted into the warp stop motion so that the warp threads do not come into conflict with the drop wires. It should also be added that the reed 14 is retained by means of a hook 19, which is suspended on the first heald frame.

After the take-over of the drawing-in device, the warp stop motion 12 and the loom harness 13, 14 are disposed one behind the other on the carriage 1 in the warp direction.

Figure 3:
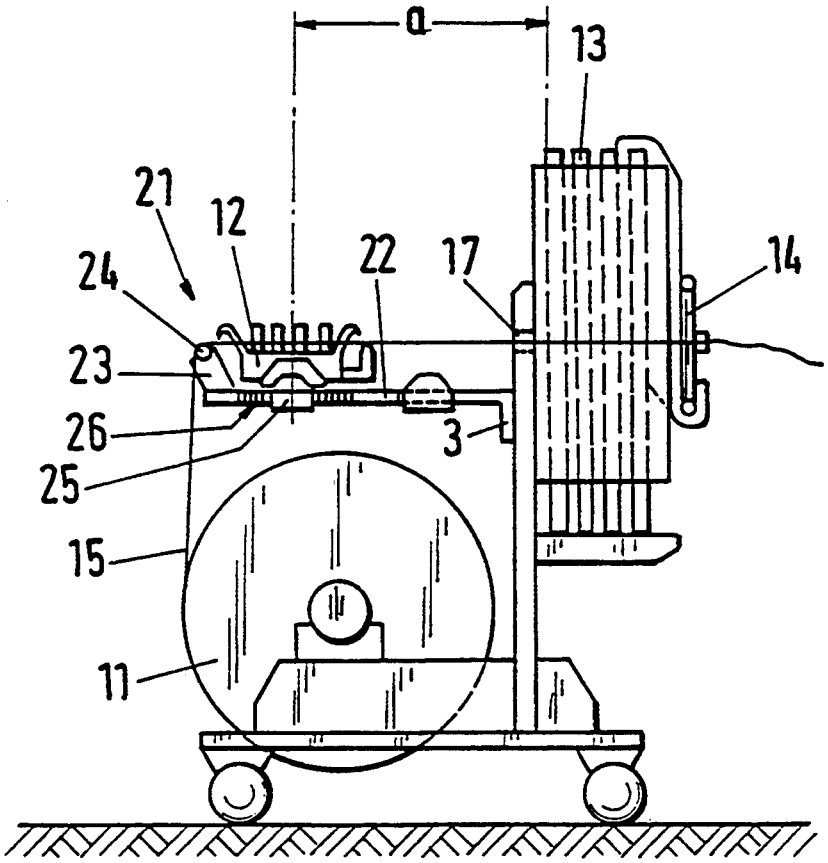
FIG. 3 shows a side view of the carriage of FIG. 2 in the position preset for the insertion of the fabric into the loom.

Reference is made to FIG. 3. In a loom as is known the position of the warp stop motion 12 depends on the number of heald frames 13, the shed size, the density of the fabric and also the warp material. In the loom this position can be adjusted by an adjustable support for the warp stop motion and the shaft guides and relates to distance a from the warp stop motion to the last heald frame. For the sake of simplicity hereinafter the distance a is given in relation to the center of the warp stop motion, although in practice the adjustment dimension is taken from the last heald frame to the first contact bar. In the following description this distance is referred to as distance a appropriate for weaving and the fabric.

A feature characterizing the present invention is that the warp stop motion 12 and the heald frames 13 are set at a distance a appropriate for weaving and the fabric.

As FIG. 3 shows, for this purpose is provided a device 21, which is introduced and fixed in the support 3 on the carriage. The device 17 contains two rests 22, which comprise at one end an arrangement (not shown) for insertion and attachment in the support 3 and at the other end a housing part 23 for a bar 24 and a support 25 for the warp stop motion 12. Each rest 22 is provided with a scale reading 26 for the adjustment of the distance a.

To adjust the distance a, after the insertion of the rest 22 the bar 24 is inserted into the recess (not shown) provided for this purpose in each housing part 23, so that the warp threads 15 are guided over this bar 24 and slightly tensioned. Subsequently the warp stop motion 12 is displaced along the rest 22 and adjusted to the distance a appropriate for weaving and the fabric by means of the scale reading. After the adjustment auxiliary bars (not shown) used for example during the drawing-in operation are laterally withdrawn to hold up the drop wires. The carriage 1 prepared in this manner may be parked as a transport and storage carriage and used when required.

Figure 4:
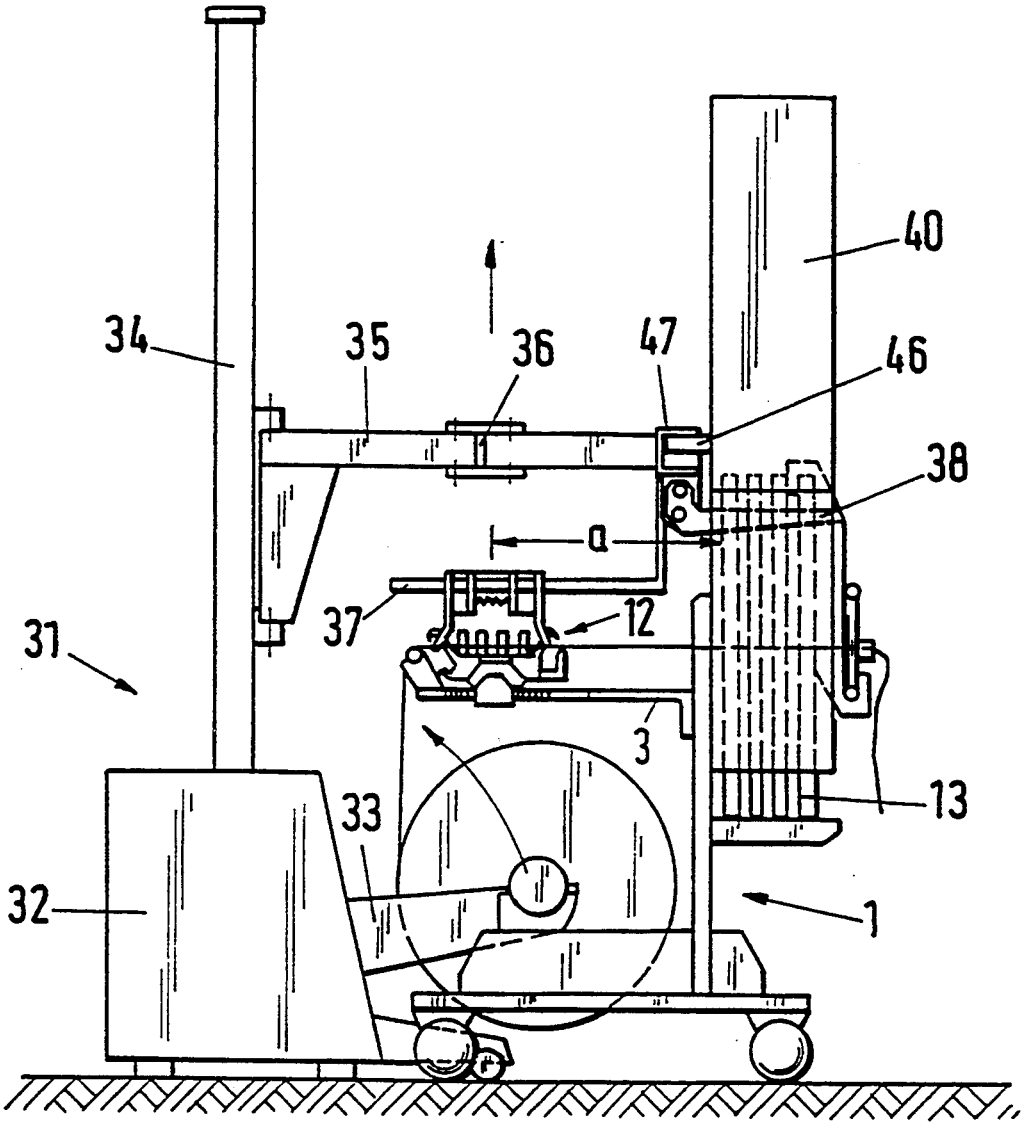
FIG. 4 shows a side view of the carriage connected to the auxiliary assembly shown in FIG. 3 during the transfer of the warp beam and of the warp stop motion and heald frames located in the position appropriate for weaving and the fabric.

For the fabric change the carriage 1 described at the beginning and provided with the fabric is coupled to a movable auxiliary assembly 31, hereinafter called the insertion carriage, as is represented in FIG. 4.

The insertion carriage 31 contains a chassis 32 having a drive unit (not represented) and a mechanism 33 for housing the warp beam 11, a stand 34, which is mounted on the chassis 32, two supports 35, which are disposed on the stand 34 so that they can move synchronously up and down, and an articulation 36, in order to swivel the supports 35, a clamp 37 to raise the warp stop motion 12 and a lever 38 to raise the heald frames 13.

A further feature characterizing the invention is that the warp stop motion 12 and the heald frames 13 are removed from the carriage 1 by the insertion carriage 31 in the spacing a appropriate for weaving and the fabric and are inserted into the loom 39.

To perform this operation a housing device 40 is provided in accordance with the invention.

Figure 5:
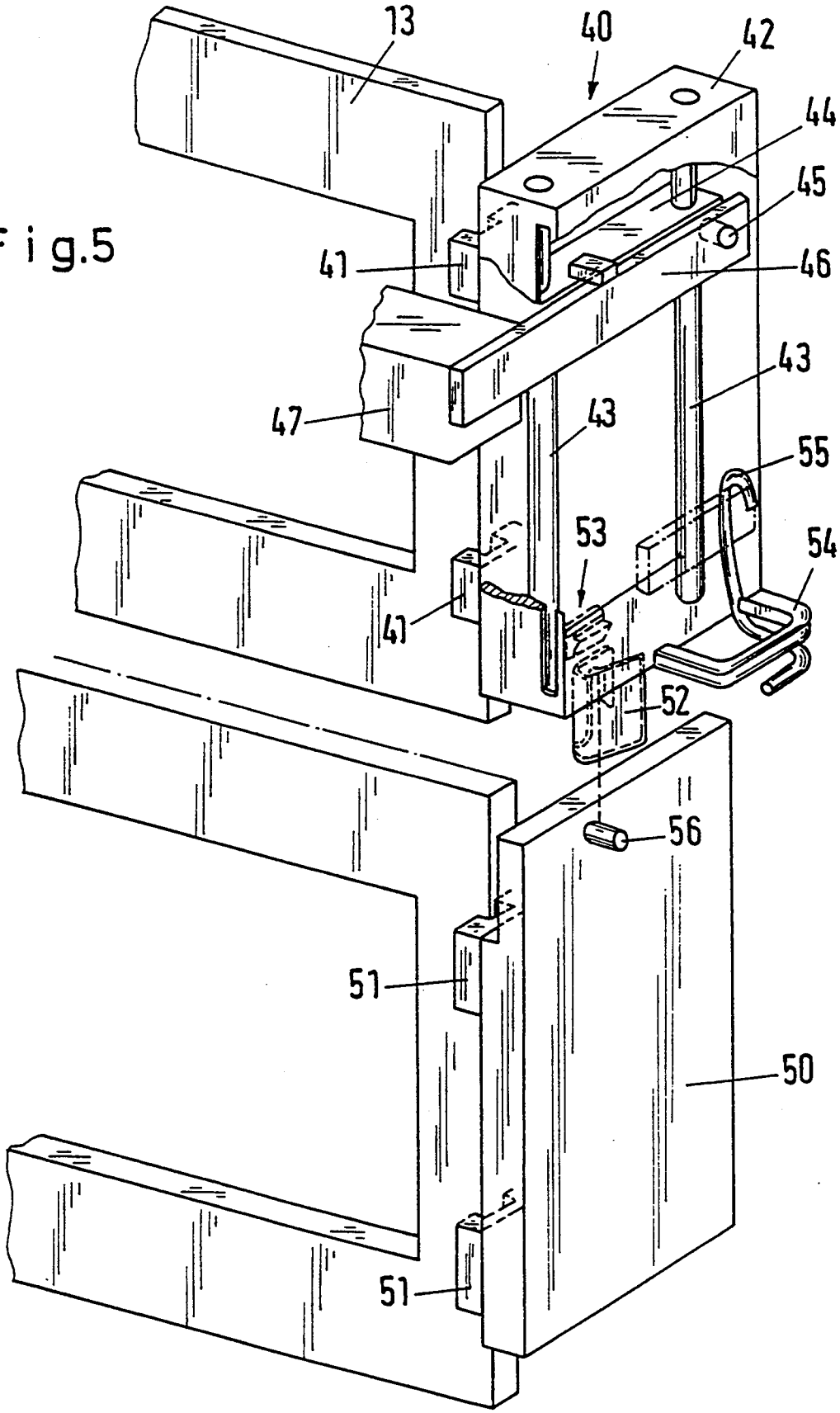
FIG. 5 shows a preferred embodiment of a housing device for the heald shafts in a three-dimensional representation.

The housing device is described below by means of FIG. 5, and only the rearmost heald frame 13 is represented in order to simplify the representation.

The device 40 contains two guide bars 41 for the heald frames 13. The guide bars 41 are attached to a housing 42. In the housing 42 are disposed two columns 43 and a retention part 44, which is attached to the housing 42 and disposed on the columns 43 so that it can move up and down. On the retention part 44 is provided a journal 45, on which a bracket 46 is pivoted in order to compensate automatically for all deviations from the horizontal plane. The bracket 46 is on the other hand attached to a beam 47, which is connected to the supports 35 (FIG. 4).

In the loom is provided a plate 50 having guide bars 51, into which the heald frames 13 are introduced during the fabric change. In order to align the guide bars 41 on the housing 42 with the guide bars 51 on the plate 50, on the underside of the housing 42 are provided first and second alignment members 52, 53. On the housing 42 there is also provided a handle 54, in order to facilitate the transfer of the heald frames from the carriage 1 by raising the device 40, and a catch 55 is provided in order to hold the housing 42 on the bracket 46 in the high position.

Figure 6:
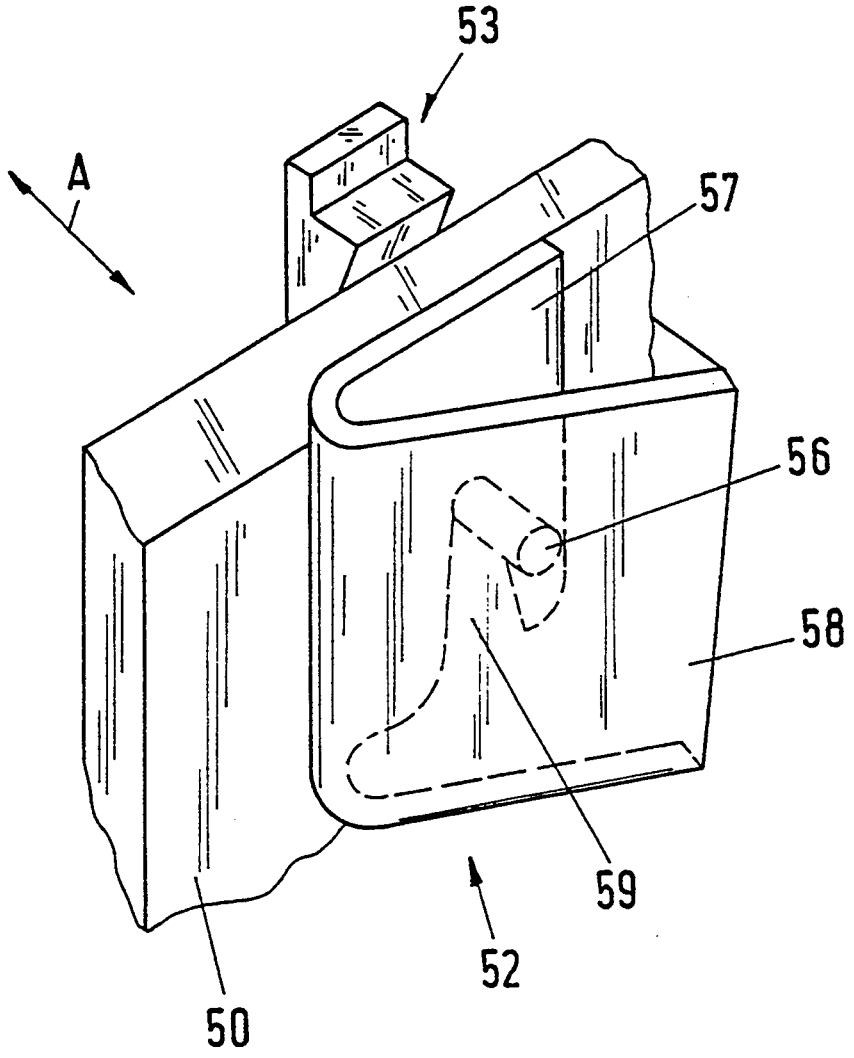
FIG. 6 shows an embodiment of alignment members for the housing device in a three-dimensional representation.

FIG. 6 shows the alignment members 52, 53 in the engagement position with the plate 50, which is provided with a journal 56. The first alignment member 52 has a V-shaped construction and is disposed so that one limb 57 lies parallel to plate 50, while the other limb 58 is disposed obliquely in relation to the plate 50. In limb 57 is constructed a slit 59, into which the journal 56 is inserted. The length of the journal 56 is such that when the housing device 40 is inserted into the loom the journal comes to abut the inside of the obliquely protruding limb 58 and aligns the housing device 40 in the direction of arrow A in relation to the loom. The second alignment member 53 has a wedge-shaped construction and is intended to center the housing device 40 on the plate 50 and simultaneously to fix it.

Figure 7:
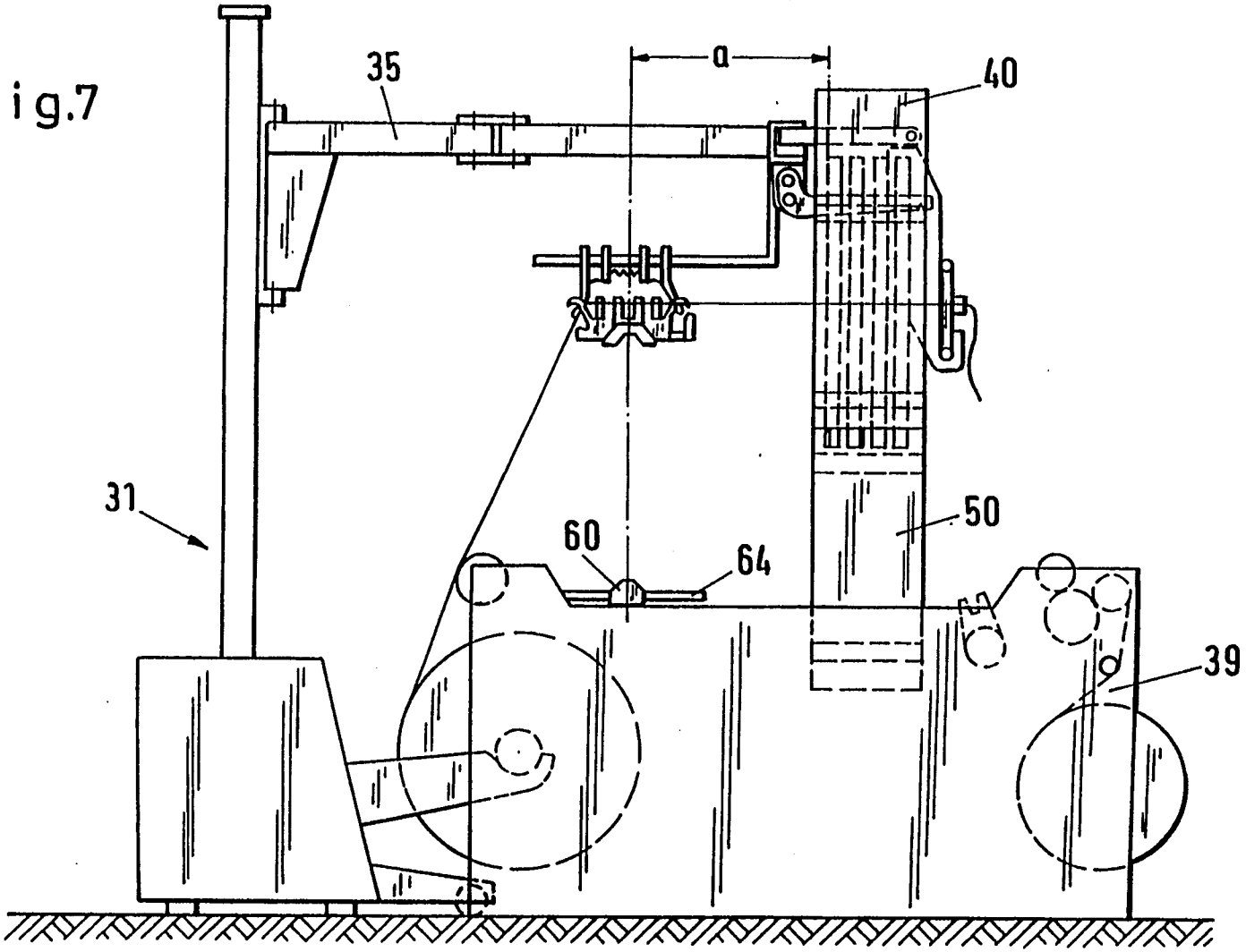
FIG. 7 shows a side view of the auxiliary assembly with the accepted fabric in the position before the insertion of the warp stop motion and of the heald frames, FIG. 8 a side view of the auxiliary assembly after the insertion of the fabric and FIG. 9 a preferred embodiment of the warp stop motion.

FIG. 7 shows the situation before the insertion of the warp stop motion 12 and the heald frames 13, which are held in the housing device 40. In the position shown the housing 42 is placed on the plate 50 (FIG. 5) and aligned and fixed in relation to the plate 50 by the paired centering or alignment members 52, 53. By lowering the supports 35 the warp stop motion 12 and the heald frames 13 are inserted simultaneously into the loom 39, whereby the warp stop motion 12 is placed on the support 60 provided in the loom and the heald frames 13 are introduced into the guide bars 51 on the plate 50. The operation is performed while maintaining the distance a appropriate for weaving and the fabric.

Figure 8:
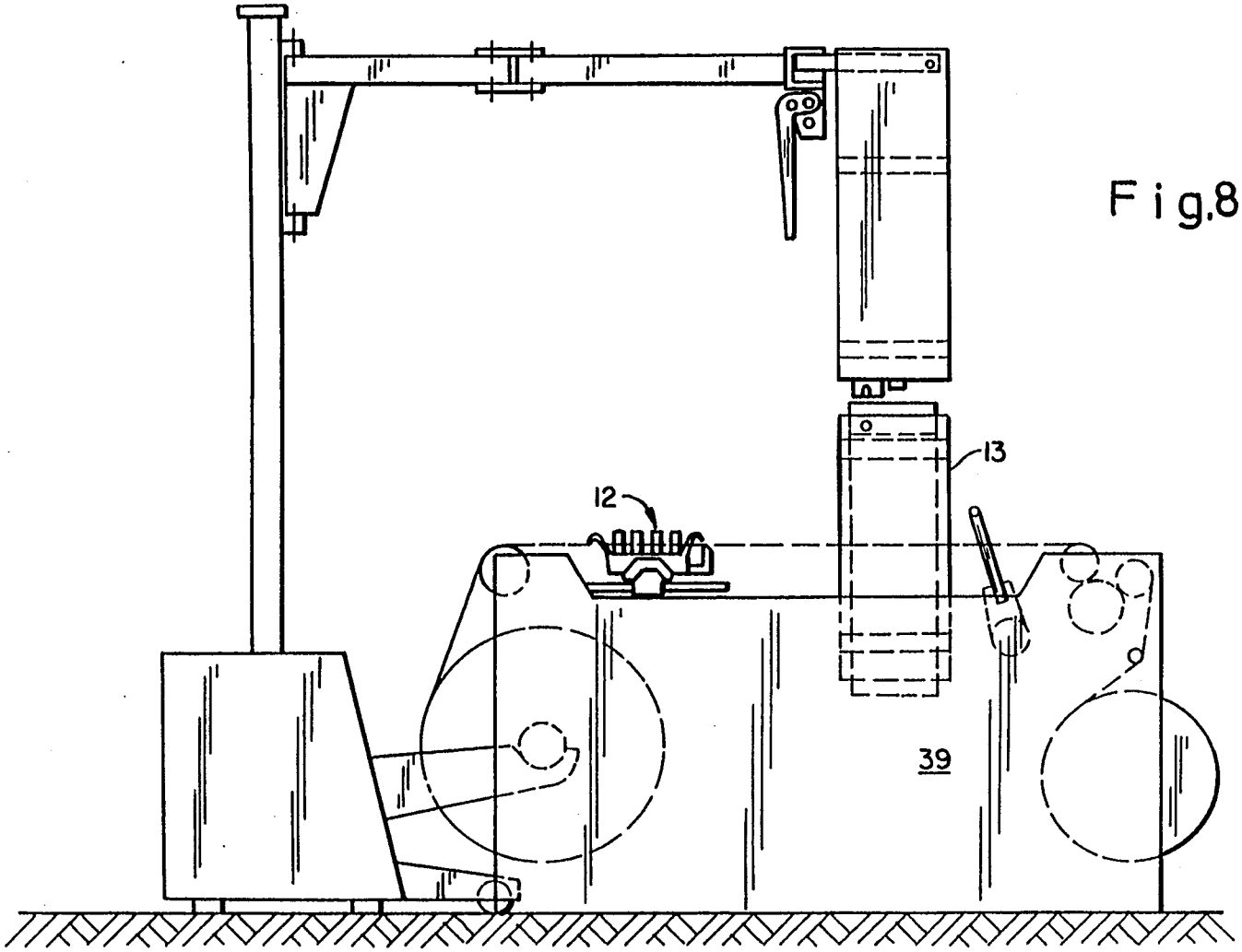
Figure 9:
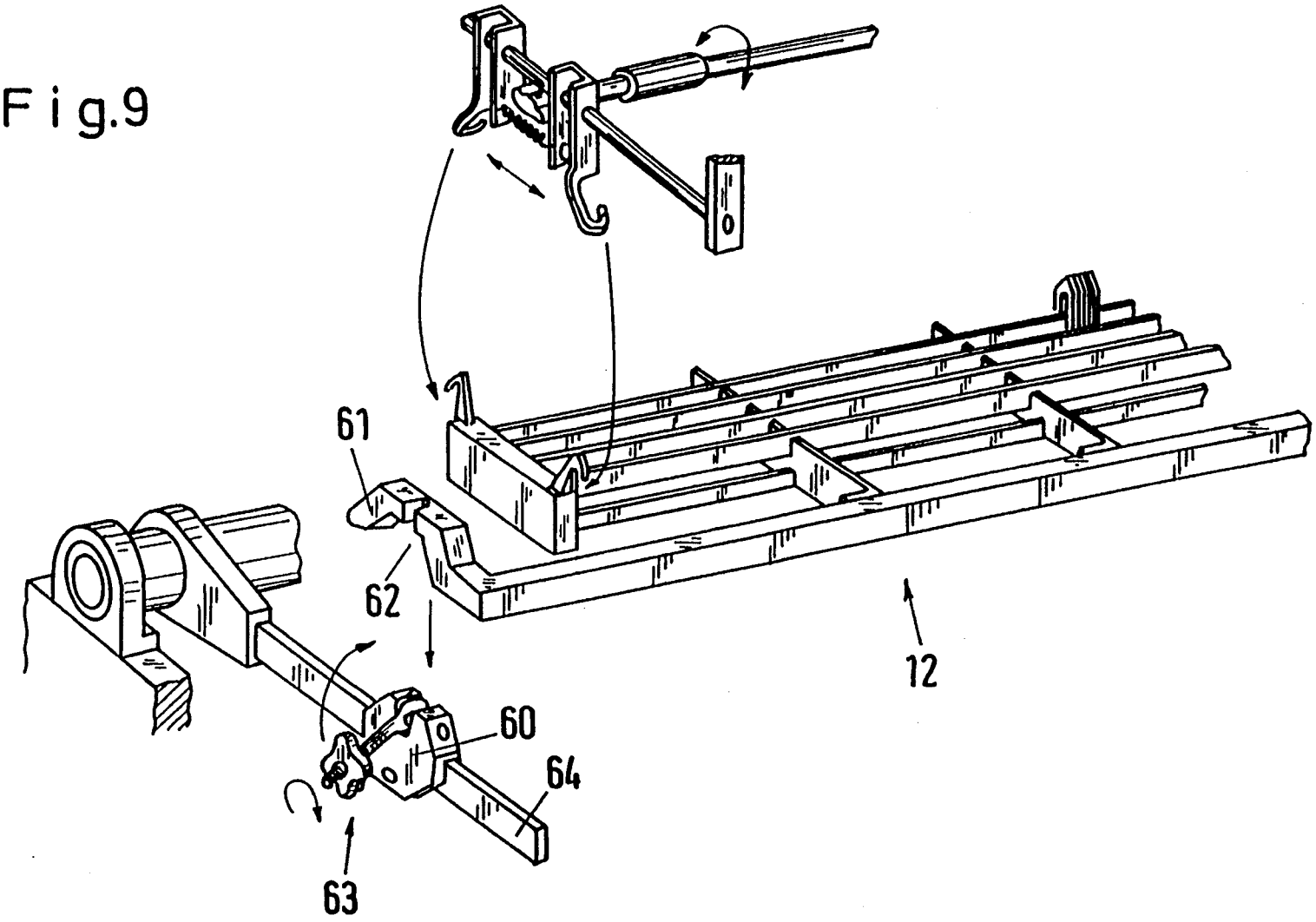

FIG. 8 and 9 shows the situation after the completion of the fabric change. Warp stop motion 12 and heald frames 13 have been placed to loom 39. Insertion carriage 31 is in the process of disengaging from loom 39.

The warp stop motion 12 is constructed as a structural unit and as such can be inserted into or removed from the loom.

At the narrow sides the structural unit comprises a portion 61 having a recess 62, which is adapted to the contours of the support on the carriage or in the loom. In order to attach the warp stop motion 12 to the loom, a snap locking mechanism having a star grip nut 63 is adjustably disposed on a bracket 64 (FIG. 9).

Although the above description only describes the changing of a fabric or a full warp beam (including the loom harness etc), it is of course possible to proceed in the corresponding reverse sequence. This occurs for example after a desired fabric length for a determined fabric has been attained in order then to store the remaining warp with the carriage 1 in an appropriate manner for weaving and the fabric until it is next used or for the replacement of an empty warp beam.

In the process the fabric is prepared on a carriage, during which the distance a between the warp stop motion and the last heald frame is adjusted, and stored.

The insertion of the fabric into a loom is performed while maintaining the set distance a.

The device includes a carriage (1) having a mechanism (21) for the adjustment of the distance a appropriate for weaving and the fabric and an auxiliary assembly having a housing device (37) for the warp stop motion (12) and a housing device (40) for the heald frames (13), in order to insert the fabric into a loom with the spacing appropriate for weaving and the fabric.

I claim:

1. In the combination of:

a carriage for the preparation and storage of a fabric to be changed having means for holding a warp beam, means for holding a warp stop motion, loom harness with heald frames, and reed;

a loom for receiving the fabric to be changed, the loom including a preselected distance between the warp stop motion and the loom harness with heald frames dependent upon shed size, density of fabric and warp material; and, an insertion carriage for picking the warp stop motion and the loom harness at the preselected distance for deposit to the loom, the improvement to the carriage for the preparation and storage of the fabric changed comprising:

a clamp on the carriage for the preparation and storage of a fabric to be changed for clamping warp to stretch the warp between the warp beam and the warp stop motion;

means for receiving and supporting the warp stop motion on the carriage for the preparation and storage of the fabric, the means for receiving and supporting disposing the warp stop motion on the warp;

means for adjusting the warp stop motion towards and away from the loom harness with heald frames mounted to the carriage for the preparation of fabric change to set the warp stop motion relative to the loom harness and heald frames dependent upon shed size, density of fabric and warp material.

2. The combination of claim 1 and wherein:

the means for adjusting the warp stop motion towards and away from the loom harness includes a bar over which the warp is guided.

3. In the method of preparing fabric to be woven on a loom in the combination of:

a carriage for the preparation and storage of a fabric change having means for holding a warp beam, means for holding a warp stop motion, loom harness with heald frames, and reed;

a loom for receiving the fabric to be changed, the loom including a preselected distance between the warp stop motion and loom harness with heald frames dependent upon shed size, density of fabric and warp material; and, an insertion carriage for picking the warp stop motion and loom harness at the preselected distance for deposit to the loom, the method for the preparation of the fabric change comprising the steps of:

providing a warp beam support on the insertion carriage;

placing the warp beam on the warp beam support;

drawing in warp to the warp beam from warp beam drawing apparatus;

providing a support for the warp stop motion on the carriage;

placing the warp stop motion on the support for the warp stop motion;

providing a clamp on the insertion carriage for clamping warp under tension over the warp stop motion and the warp beam;

clamping the warp between the warp stop motion and the warp beam;

providing an adjustable support for the warp stop motion for adjusting the warp stop motion towards and away from the loom harness with heald beams;

during the clamping step adjusting the warp stop motion towards and away from the loom harness with heald frames for the preparation of fabric change to set the warp stop motion relative to the loom harness and heald frames dependent upon shed size, density of fabric and warp material.

4. In the method of preparing fabric to be woven on a loom according to claim 3 and comprising the further steps of:

straightening the warp during the adjusting step.

5. In the method of preparing fabric to be woven on a loom according to claim 4 and comprising the further steps of:

straightening the warp during the adjusting step includes inserting a bar at the warp stop motion.

6. In the method of preparing fabric to be woven on a loom according to claim 3 and comprising the further steps of:

the adjusting the warp stop motion towards and away from the loom harness step includes adjusting the distance between the warp stop motion and the last heald frame.

7. In the combination of:

a carriage for the preparation and storage of a fabric change having means for holding a warp beam, means for holding a warp stop motion, loom harness with heald frames, and reed;

a loom for receiving the fabric to be changed, the loom including a preselected distance between the warp stop motion and loom harness with heald frames dependent upon shed size, density of fabric and warp material; and, an insertion carriage for picking the warp stop motion and loom harness at the preselected distance for deposit to the loom, the improvement to the insertion carriage comprising:

two rests with supports for the warp stop motion are mounted to the insertion carriage;

each support is associated with an adjustment mechanism for moving the warp stop motion towards and away from the loom harness with heald frames; and, paired centering devices are provided to house loom harness with heald frames in the insertion carriage; and, guides on the loom to co-act with the paired centering devices on the insertion carriage.

* * * * *